United States Patent [19]

Weber

[11] 4,164,798

[45] Aug. 21, 1979

[54] SEAT CUSHION

[76] Inventor: Joseph T. Weber, P.O. Box 26424, Charlotte, N.C. 28213

[21] Appl. No.: 708,132

[22] Filed: Jul. 23, 1976

[51] Int. Cl.[2] ..... A47C 27/08

[52] U.S. Cl. ..... 5/464; 297/456

[58] Field of Search ..... 5/338, 345, 355; 297/456, 459

[56] References Cited

U.S. PATENT DOCUMENTS

| | | | |
|---|---|---|---|
| 2,305,173 | 12/1942 | Leeb | 5/338 |
| 2,659,418 | 11/1953 | Berman | 5/338 X |
| 3,222,694 | 12/1965 | Schick | 5/338 |
| 3,378,862 | 4/1968 | Skinner | 5/338 X |
| 3,611,455 | 10/1971 | Gottfried | 5/338 |

*Primary Examiner*—Victor N. Sakran

*Attorney, Agent, or Firm*—Andrew F. Sayko, Jr.

[57] ABSTRACT

The present invention comprises a seat cushion for preventing excessive pressure on the coccyx of a person sitting on the cushion; the cushion is made from a seat pad having a casing with a resilient cushioning element positioned within; the cushioning element has a recessed portion in the rear center so as to be in underlying relationship to the coccyx; the casing is free of a recessed portion and provides nominal support for the coccyx.

3 Claims, 4 Drawing Figures

SEAT CUSHION

THE INVENTION

The present invention relates to an improved seat cushion for preventing pressure on the coccyx (the end of the vertebral column beyond the sacrum) of a person sitting thereon. Various seat pads have been used for preventing pressure on a tender coccyx; however the present invention provides a seat cushion or pad which, although preventing excess pressure on the coccyx, does not leave the coccyx without any support at all.

It is an object of the present invention to provide a novel seat cushion for preventing excessive pressure on the base of a person's spine, the cushion including a seat pad portion and a back rest portion, the seat pad portion having an internal resilient cushion with a recess therein, said recess to be positioned in underlying relationship to the base of the vertebral column (the coccyx).

It is another object of the present invention to provide an improved seat cushion which prevents excessive pressure on the coccyx but does not leave the coccyx without any support at all and wherein relative movement between the seat pad portion and backrest portion of the seat cushion is precluded.

Other objects of the present invention will be readily seen from the description which follows:

DESCRIPTION OF THE INVENTION

The improved seat cushion of the present invention includes a seat pad portion with a casing having a resilient cushioning element positioned therein. The resilient cushioning element has a recessed portion for permitting a person to sit on the pad without subjecting the base of his spine to excessive pressure. However, the casing does not have such a recessed portion so that, even though excessive pressure on the coccyx is prevented, the coccyx is not left without any support at all. In addition, permanently or temporarily attached to the seat pad portion is a back rest portion which is conformable to the back of a chair, car seat, etc., and which prevents sliding movement of the seat pad portion as the person moves and prevents relative movement between the seat pad portion and the back rest portion. The back rest, when placed on a vehicle seat, chair or the like, is positioned against the rear of the seat in such a manner so as to place the recess of the internal resilient cushion of the seat pad portion in underlying aligned relationship with the coccyx.

The seat cushion of the present invention includes a seat pad portion and a back rest portion which are attached to each other and which may be detachable from each other for convenience. The seat pad portion includes a resilient cushion, which may be fabricated from urethane foam or other suitable resilient material, which is positioned within a casing. The urethane foam may have a smooth or contoured surface and may be of any desired thickness, whether the surface is contoured or substantially planar. The portion of the casing containing the resilient cushion, which comes in contact with the person sitting on the seat cushion, may be made from or have a surface of a fluffy, moisture-absorbing fibrous material, such as natural or artificial sheepskin such as those manufactured from short-length polyester fibers. The rest of the seat cushion casing, which does not come in contact with the body of the user and which comes in contact with the surface, usually a chair or car seat, upon which the seat cushion is used, may be fabricated from any suitable textile material, but preferably the casing surface which does not come in contact with the user, will have a surface which has relatively high frictional characteristics when rubbed over a vinyl or like material which may be utilized for vehicle seat covers or chair seat cushion covers. Such a surface may preferably be a ribbed material such as a ribbed corduroy textile surface fabric made from any suitable textile material such as cotton, wool, nylon, polyester, etc., fibrous material.

The rear portion of the resilient cushion has a hollowed out portion in the rear center thereof, which hollowed out portion corresponds to the part of the seat where a person's coccyx or tail bone would rest in a normal sitting position. The casing provides nominal support for the coccyx, but the hollowed out portion prevents excessive pressure on the coccyx and hence relieves and prevents backaches and a painful coccyx when sitting for long periods of time.

The present invention will be more clearly understood when the specification is read in conjunction with the following drawings wherein.

Figure 1:
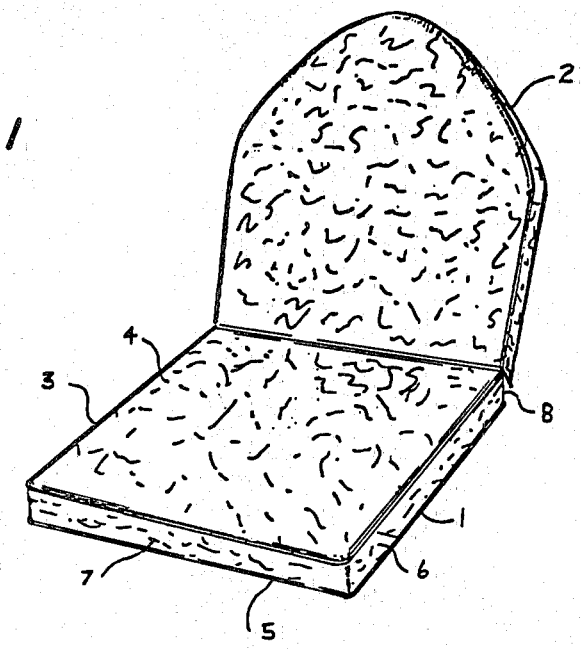
FIG. 1 is a perspective view of the improved seat cushion of the present invention.
Figure 2:
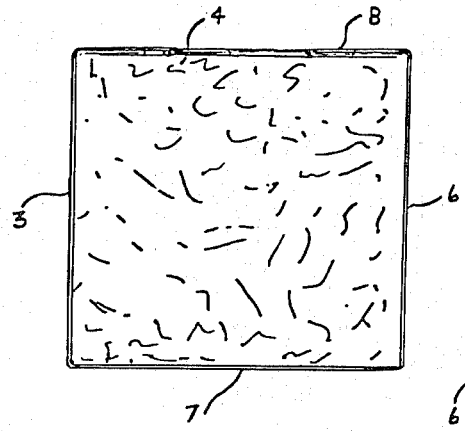
FIG. 2 is a plan view of the outside of the seat pad.
Figure 3:
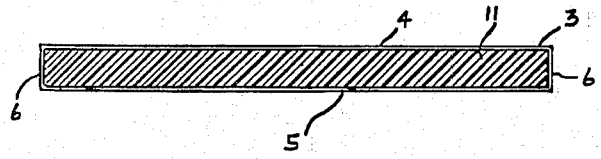
FIG. 3 is a cross-sectional view of the seat pad of FIG. 1.

The improved seat cushion of the present invention is shown in its preferred embodiment in FIG. 1 and consists essentially of a seat pad portion 1 and a back rest portion 2. The seat pad portion 1 includes a casing 3, which is fabricated from any suitable fabric material. The casing 3 includes a top surface 4, a bottom surface 5, a pair of side walls 6, a front wall 7 and rear wall 8. The side walls 6, front wall 7 and rear wall 8 are sewed to the top surface 4 and bottom surface 5 in such a manner that when the casing 3 is right-side out, the sewing will be enclosed on the inside and welting may be provided at the outside seam.

Figure 4:
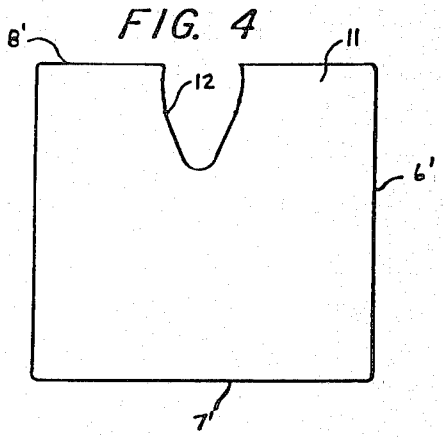
FIG. 4 is a plan view of the resilient cushioning element which is positioned within the casing of the seat pad.

A resilient cushioning element 11 (FIG. 4) which is usually fabricated from polyurethane foam is positioned within casing 3. The cushioning element 11 must be of a size sufficient to fill the casing 3 and to insure that the corners are filled with foam and that the foam fits flush in the corners. The cushioning element 11 has a pair of side walls 6', a front wall 7' and a rear wall 8' which correspond substantially in size to the size of the walls 6, 7 and 8 of the casing 3. The cushioning element 11 also contains a recessed portion 12 which may be a hole cut through the foam or may be as little as 30 percent of the thickness of the foam, i.e., the recessed portion 12 of the cushioning element comprises from about 30 percent to 100 percent of the thickness of the resilient cushioning element 11. The recessed portion 12 can be of about any shape the imagination dictates, e.g., key-hole shaped, V-shaped, semicircular, etc.

The recessed portion 12 of the cushioning element 11 within the casing 3 is adapted to be positioned below the coccyx of a person sitting on the seat cushion. The casing 3 does not have a recessed portion so that the seat cushion serves the purpose of supporting the bone structure within the buttocks while permitting the spinal column and coccyx to rest upon the surface of the seat cushion without excessive pressure being put on the coccyx. However, the coccyx is not left without any support at all, this support being provided by the casing around the resilient cushioning element 11.

The seat pad 1 comprising the seat pad casing 3 and resilient cushioning element 11 may be used by itself. However, for both comfort and convenience, it is preferred that the seat pad 1 be utilized in conjunction with a back rest portion 2 (as shown in FIG. 1). The back rest portion 2 is also provided with a resilient cushioning element (not shown) whose shape corresponds substantially to the space within the casing of the back rest portion 2. The back rest portion not only provides a more comfortable seat cushion, but also helps to prevent the seat portion 1 from changing position, both with respect to the seat upon which the seat cushion is positioned, and with respect to the coccyx of the person sitting upon the seat pad portion 1. If the recessed portion 12 of the resilient cushioning element 11 were to move out of underlying relationship with the coccyx of the person utilizing the seat cushion, the pressure and pain-relieving purpose of the seat cushion of this invention could be frustrated. Therefore, in the preferred embodiment of the present invention, a seat pad portion 1 is combined with a back rest portion 2, as shown in FIG. 1.

The recessed portion 12 of the cushioning element 11 must be large enough to relieve the pressure on the coccyx of a person utilizing the seat pad, but must not be too large so as to inadequately support the remaining bone structure within the buttocks. Therefore, it is preferred that the recessed portion has a width along the back wall 8' of from about 2 to 6 inches and have a length measured from the back wall 8' in the direction of the front wall 7' of the cushioning element 11 of from about 3 to 8 inches.

It is also preferred that the top surface of the casing for both the seat pad portion and back rest portion be covered with a fluffy, mositure-absorbing material such as natural or artificial sheep skin, such as those manufactured from short-length polyester fibers. In addition, it is preferred that the cottom surface of the casing material, which comes in contact with the surface upon which the seat cushion is used, be fabricated from a suitable textile material such that this surface will have a relatively high coefficient of friction when rubbed over vinyl or the like material which may be utilized for vehicle seat covers or chair seat cushion covers.

Having described the present invention and its preferred embodiment, we desire to claim the following:

1. A seat cushion for preventing excessive pressure on the coccyx of a person sitting on said cushion, said cushion consisting essentially of a seat pad having a casing, said casing having positioned therein a resilient cushioning element, said cushioning element having a recessed portion therein, said recessed portion located in the rear center portion of said cushioning element so as to be in underlying relationship to the coccyx, said casing being free of a recessed portion and providing means for nominally supporting the coccyx, the surface of said casing which comes in contact with the person sitting on said seat cushion consisting essentially of a fluffy, moisture-absorbing fibrous material.

2. The seat cushion of claim 1, wherein a back rest is attached to said seat pad, said back rest consisting essentially of a casing having positioned therein a resilient cushioning element, said back rest providing means for preventing substantial movement of said seat pad.

3. The seat cushion of claim 1, wherein said recessed portion of said resilient cushioning element has a width of from about 2 to 6 inches and a length of from about 3 to 8 inches.

* * * * *